US011796220B2

(12) United States Patent
Mao et al.

(10) Patent No.: US 11,796,220 B2
(45) Date of Patent: Oct. 24, 2023

(54) AIR CONDITIONER INDOOR UNIT WITH MOVABLE TOP COVER

(71) Applicants: GD MIDEA AIR-CONDITIONING EQUIPMENT CO., LTD., Foshan (CN); MIDEA GROUP CO., LTD., Foshan (CN)

(72) Inventors: Xianyou Mao, Foshan (CN); Zhiqiang Liu, Foshan (CN); Weitao Xie, Foshan (CN); Shupeng Chen, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 611 days.

(21) Appl. No.: 16/497,259

(22) PCT Filed: Apr. 25, 2019

(86) PCT No.: PCT/CN2019/084279
§ 371 (c)(1),
(2) Date: Sep. 24, 2019

(87) PCT Pub. No.: WO2020/177201
PCT Pub. Date: Sep. 10, 2020

(65) Prior Publication Data

US 2021/0325080 A1 Oct. 21, 2021

(30) Foreign Application Priority Data

Mar. 6, 2019 (CN) ..... 201910168486.2
Mar. 6, 2019 (CN) ..... 201920286587.5

(51) Int. Cl.
*F24F 13/20* (2006.01)
*F24F 11/89* (2018.01)
(Continued)

(52) U.S. Cl.
CPC ..... *F24F 13/20* (2013.01); *F24F 11/89* (2018.01); *F24F 13/32* (2013.01); *F24F 1/005* (2019.02); *F24F 2120/12* (2018.01)

(58) Field of Classification Search
CPC .. F24F 1/005; F24F 11/30; F24F 11/89; F24F 13/32; F24F 2120/10; F24F 13/12; F24F 13/20; F24F 2120/12; F24F 2221/26
See application file for complete search history.

(56) References Cited

U.S. PATENT DOCUMENTS

2010/0168921 A1 7/2010 Ju et al.
2012/0158189 A1* 6/2012 Cho ..... F24F 11/62 700/276

FOREIGN PATENT DOCUMENTS

CN 101430114 A 5/2009
CN 101493246 A 7/2009
(Continued)

OTHER PUBLICATIONS

Japan Patent Office (JPO) The Office Action for JP Application No. 2019-552510 dated Jun. 29, 2021 9 Pages (Translation Included).
(Continued)

*Primary Examiner* — Travis Ruby
(74) *Attorney, Agent, or Firm* — ANOVA LAW GROUP PLLC

(57) ABSTRACT

An air conditioner indoor unit includes a housing, a collection device, and a lifting device. The housing includes a body and a top cover. A top of the body includes a fitting port and the top cover is disposed at the fitting port. The collection device is disposed at the top cover. The lifting device is coupled to the top cover and configured to drive the top cover to move between a storage position and a detection position that allows the collection device to collect external information outside the housing.

20 Claims, 13 Drawing Sheets

(51) Int. Cl.

| | |
|---|---|
| ***F24F 13/32*** | (2006.01) |
| *F24F 120/12* | (2018.01) |
| *F24F 1/005* | (2019.01) |

(56) References Cited

FOREIGN PATENT DOCUMENTS

| | | | | | |
|---|---|---|---|---|---|
| CN | 101509681 | A | | 8/2009 | |
| CN | 101639249 | A | | 2/2010 | |
| CN | 201637054 | | * | 12/2010 | |
| CN | 106322529 | | * | 1/2011 | F24F 1/0014 |
| CN | 203362551 | | * | 12/2013 | F24F 13/10 |
| CN | 104566671 | | * | 4/2015 | F24F 13/082 |
| CN | 104566878 | | * | 4/2015 | F24F 3/16 |
| CN | 104949220 | | * | 9/2015 | F24F 8/10 |
| CN | 10509115 | | * | 11/2015 | F24F 13/32 |
| CN | 105135652 | | * | 12/2015 | F24F 13/10 |
| CN | 205261857 | U | | 5/2016 | |
| CN | 106322529 | A | | 1/2017 | |
| CN | 106642618 | | * | 5/2017 | F24F 1/0005 |
| CN | 106678971 | A | | 5/2017 | |
| CN | 106895482 | A | | 6/2017 | |
| CN | 206449815 | U | | 8/2017 | |
| CN | 207501377 | U | | 6/2018 | |
| CN | 109151292 | | * | 1/2019 | F24F 1/0007 |
| CN | 109151292 | A | | 1/2019 | |
| CN | 109200689 | | * | 1/2019 | B01D 46/0005 |
| CN | 209689064 | U | | 11/2019 | |
| CN | 112503754 | | * | 3/2021 | F24F 13/20 |
| JP | 2006105459 | A | | 4/2006 | |
| KR | 100626702 | B1 | | 9/2006 | |
| KR | 100732040 | B1 | | 6/2007 | |
| KR | 20090043234 | | * | 5/2009 | F24F 13/20 |
| KR | 20090043234 | A | | 5/2009 | |
| KR | 20090043238 | | * | 5/2009 | F24F 13/32 |
| KR | 20090085895 | A | | 8/2009 | |
| KR | 20090086746 | A | | 8/2009 | |
| KR | 20100025357 | A | | 3/2010 | |
| KR | 20100050312 | | * | 5/2010 | F24F 2120/10 |
| KR | 101431751 | | * | 8/2014 | F24F 13/20 |
| KR | 101431751 | B1 | | 8/2014 | |
| KR | 20180011694 | A | | 2/2018 | |
| WO | WO-2017041698 | A1 | * | 3/2017 | F16H 19/04 |
| WO | 2018196591 | A1 | | 11/2018 | |

OTHER PUBLICATIONS

World Intellectual Property Organization (WIPO) International Search Report and Written Opinion for PCT/CN2019/084279 dated Nov. 18, 2019 17 Pages.

The European Patent Office (EPO) Extended Search Report for EP Application No. 19769369.0 dated Jun. 3, 2020 8 Pages.

Korean Intellectual Property Office (KIPO) The First Office Action For KR Application No. 10-2019-7030418 dated Nov. 19, 2020 12 Pages (Translation Included).

The China National Intellectual Property Administration (CNIPA) The First Office Action for Chinese Application 201910168486.2 dated Jul. 28, 2023 16 Pages (With Translation).

* cited by examiner

AIR CONDITIONER INDOOR UNIT WITH MOVABLE TOP COVER

CROSS-REFERENCES TO RELATED APPLICATIONS

This application is a National Stage Entry under 35 U.S.C. § 371 of International Application No. PCT/CN2019/084279, filed on Apr. 25, 2019, which is based on Chinese patent application No. 201910168486.2, filed on Mar. 6, 2019, and Chinese patent application No. 201920286587.5, filed on Mar. 6, 2019, and claims priority to the above Chinese patent applications, all of which are incorporated herein by reference in their entirety.

FIELD

The present disclosure relates to the field of air conditioner, and in particular to an air conditioner indoor unit.

BACKGROUND

In the related art, an air conditioner indoor unit is generally used for adjusting temperature and humidity of the indoor environment, and the air conditioner indoor unit generally needs a collection device to collect information during operating. However, the collection device easily leaks the privacy of the user, and the user experience is poor.

SUMMARY

The present disclosure aims to address at least one of the technical problems existing in the related art. To this end, the present disclosure proposes an air conditioner indoor unit, which is advantageous for improving the user experience.

An air conditioner indoor unit in accordance with an embodiment of the present disclosure comprises: a housing including a body and a top cover, wherein the top of the body has a fitting port, and the top cover is disposed at the fitting port; a collection device disposed at the top cover; a lifting device positioned within the body, the lifting device being coupled to the top cover to drive the top cover to be movable between a storage position and a detection position where the collection device can collect the external information outside the housing.

In the air conditioner indoor unit in accordance with the embodiment of the present disclosure, the collection device is provided so as to facilitate collection of the external information outside the housing; the lifting device is provided so as to implement the movement of the top cover between the storage position and the detection position and facilitate the collection device to collect information, while facilitating to ensure the privacy of users and improve the user experience.

According to some embodiments of the present disclosure, the lifting device is configured to drive the top cover to move above the body such that the collection device is positioned above the body. This ensures the collection angle of view of the collection device.

According to some embodiments of the present disclosure, the collection device is disposed at an inner side wall of the top cover, thus ensuring the concealment of the collection device.

According to some embodiments of the present disclosure, at the storage position, the top cover is flush with the top of the body, thus further ensuring the concealment of the collection device.

According to some embodiments of the present disclosure, the top of the lifting device is snap-fitted with the top cover, thereby facilitating disassembly and assembly between the lifting device and the top cover.

According to some embodiments of the present disclosure, the top cover is provided with a positioning hole, and the top of the lifting device is provided with a positioning post which protrudes into the positioning hole. Such structure is simple and it is convenient to implement the structure.

According to some embodiments of the present disclosure, the lifting device includes: a motor which is positioned within the body; a gear which cooperates with the motor to be driven to rotate by the motor; a rack engaged with the gear, a top end of the rack being coupled to the top cover to drive the top cover to move. Thus, the movement of the top cover is realized, and the structure is simple and is stable in operation.

According to some embodiments of the present disclosure, the number of the lifting device is two, and the lifting devices are distributed on the left and right sides of the top cover, to ensure that the top cover is stressed more evenly.

According to some embodiments of the present disclosure, the lifting device further includes a casing, the motor and the gear are stored in the casing, the top of the casing is provided with an opening, and the rack can protrude from the casing through the opening. This facilitates to implement the modular design of the lifting device while ensuring smooth movement of the rack.

According to some embodiments of the present disclosure, the air conditioner indoor unit further includes first sliding portion and a second sliding portion that that are slidably fitted. The first sliding portion is positioned in the housing, and the second sliding portion is coupled to the top cover. This ensures the stability of the movement of the top cover.

According to some embodiments of the present disclosure, the second sliding portion protrudes into the first sliding portion, further ensuring the stability of the movement of the top cover.

According to some embodiments of the present disclosure, the air conditioner indoor unit further includes a fixing plate which is disposed at an inner peripheral wall of the body, and the first sliding portion is disposed at the fixing plate, thereby facilitating to dispose the first sliding portion and simplify the structure of the first sliding portion.

According to some embodiments of the present disclosure, the lifting device is fixed at the fixing plate. This facilitates mounting of the lifting device.

According to some embodiments of the present disclosure, the air conditioner indoor unit further includes a guiding plate for guiding the top cover to move, the guiding plate extends downward from an outer periphery of the top cover, and the guiding plate is located inside the fitting port. This facilitates to quickly switch the position of the top cover.

According to some embodiments of the present disclosure, the collection device is a camera, thus facilitating to collect the external information outside the housing.

Additional aspects and advantages of the present disclosure will be more apparent in the description below, or may be learned via the practice of the present disclosure.

BRIEF DESCRIPTION OF THE DRAWINGS

The foregoing and/or additional aspects and advantages of the present disclosure will become apparent and understandable from the following description of the embodiments in conjunction with the accompanying drawings, wherein.

Figure 1:
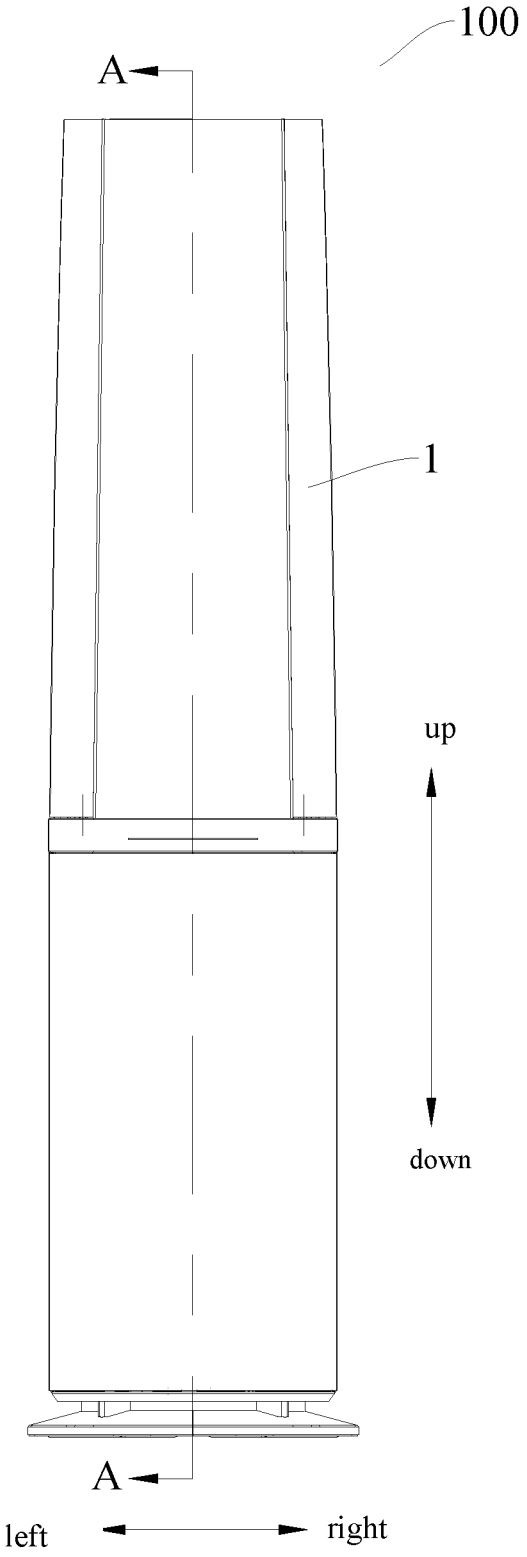
FIG. 1 is a front view of an air conditioner indoor unit according to an embodiment of the present disclosure, wherein a top cover is in a storage position.
Figure 2:
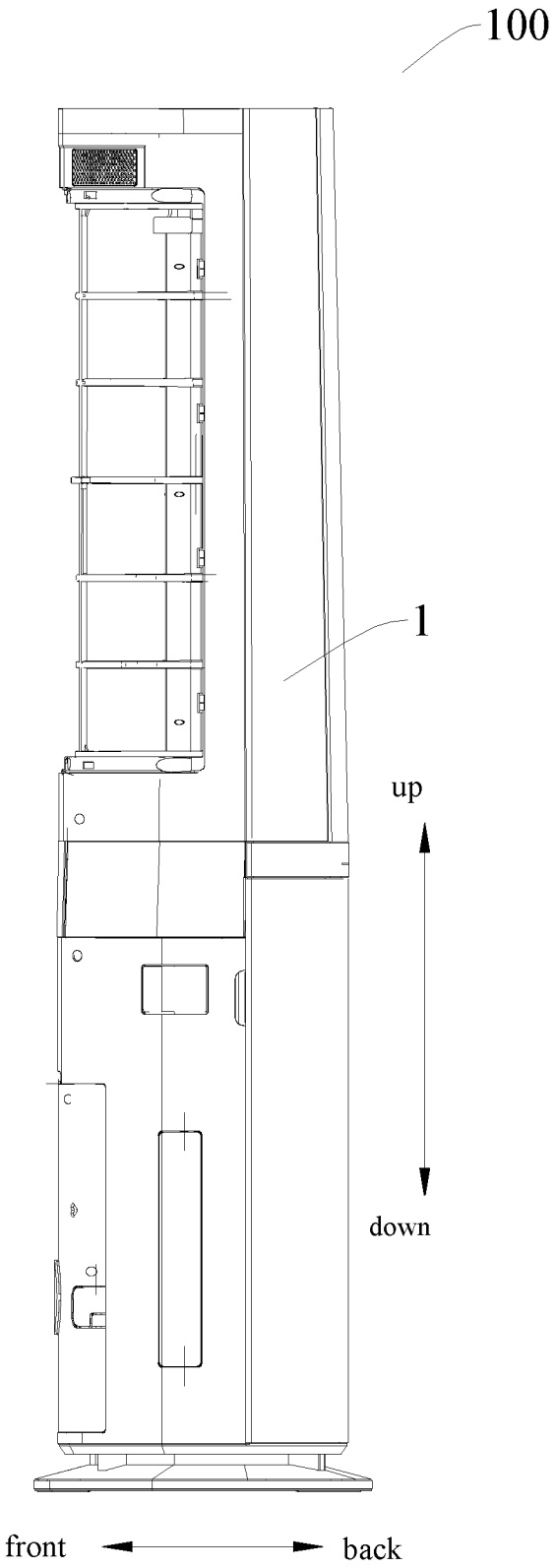
FIG. 2 is a side view of the air conditioner indoor unit shown in FIG. 1.
Figure 3:
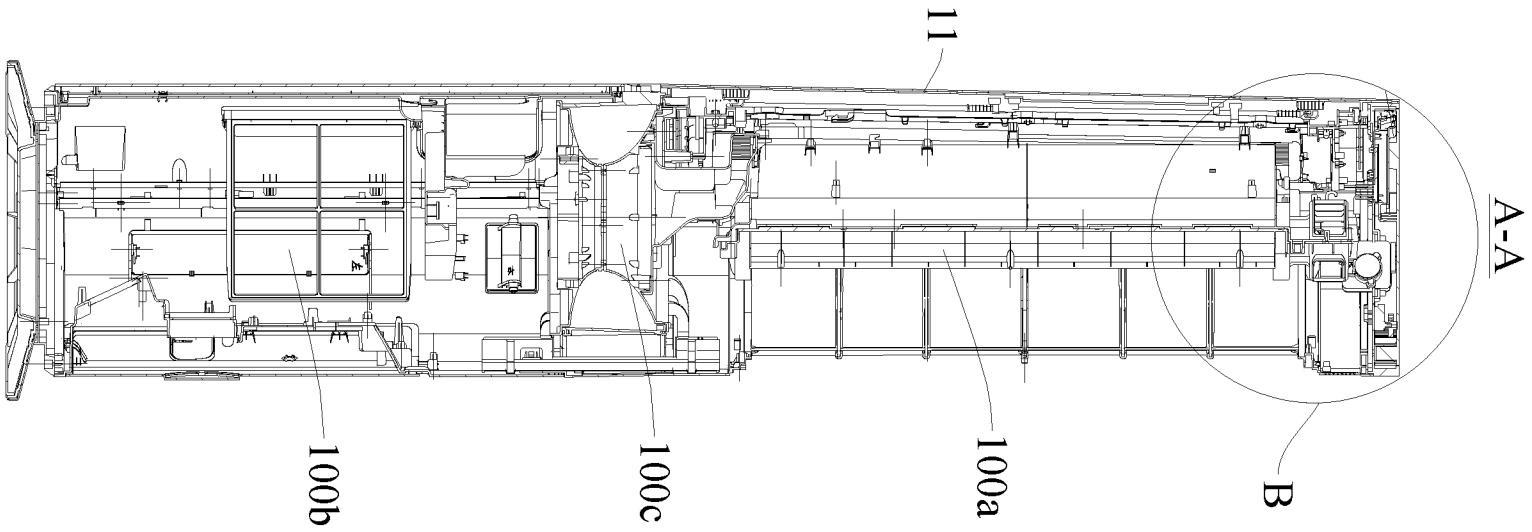
FIG. 3 is a cross-sectional view taken along line A-A of FIG. 1.

The reference numerals: Air conditioner indoor unit 100, indoor heat exchanger 100*a*, air processor 100*b*, intermediate support 100*c*, housing 1, body 11, fitting port 111, top cover 12, positioning hole 121, collection device 2, lifting device 3, positioning post 30, motor 31, gear 32, rack 33, casing 34, installation space 340, opening 341, through hole 342, mounting portion 343, supporting member 35, sliding portion 4, first sliding portion 41, second sliding portion 42, fixing plate 5, mounting position 51, guiding plate 6.

DETAILED DESCRIPTION OF THE EMBODIMENTS

The embodiments of the present disclosure are described in detail below, and the examples of the embodiments are illustrated in the drawings, wherein the same or similar reference numerals are used to refer to the same or similar elements or elements having the same or similar functions. The embodiments described below with reference to the accompanying drawings are intended to be illustrative only, and are not to be construed as limiting.

An air conditioner indoor unit 100 in accordance with some embodiments of the present disclosure is described below with reference to the accompanying drawings.

Figure 6:
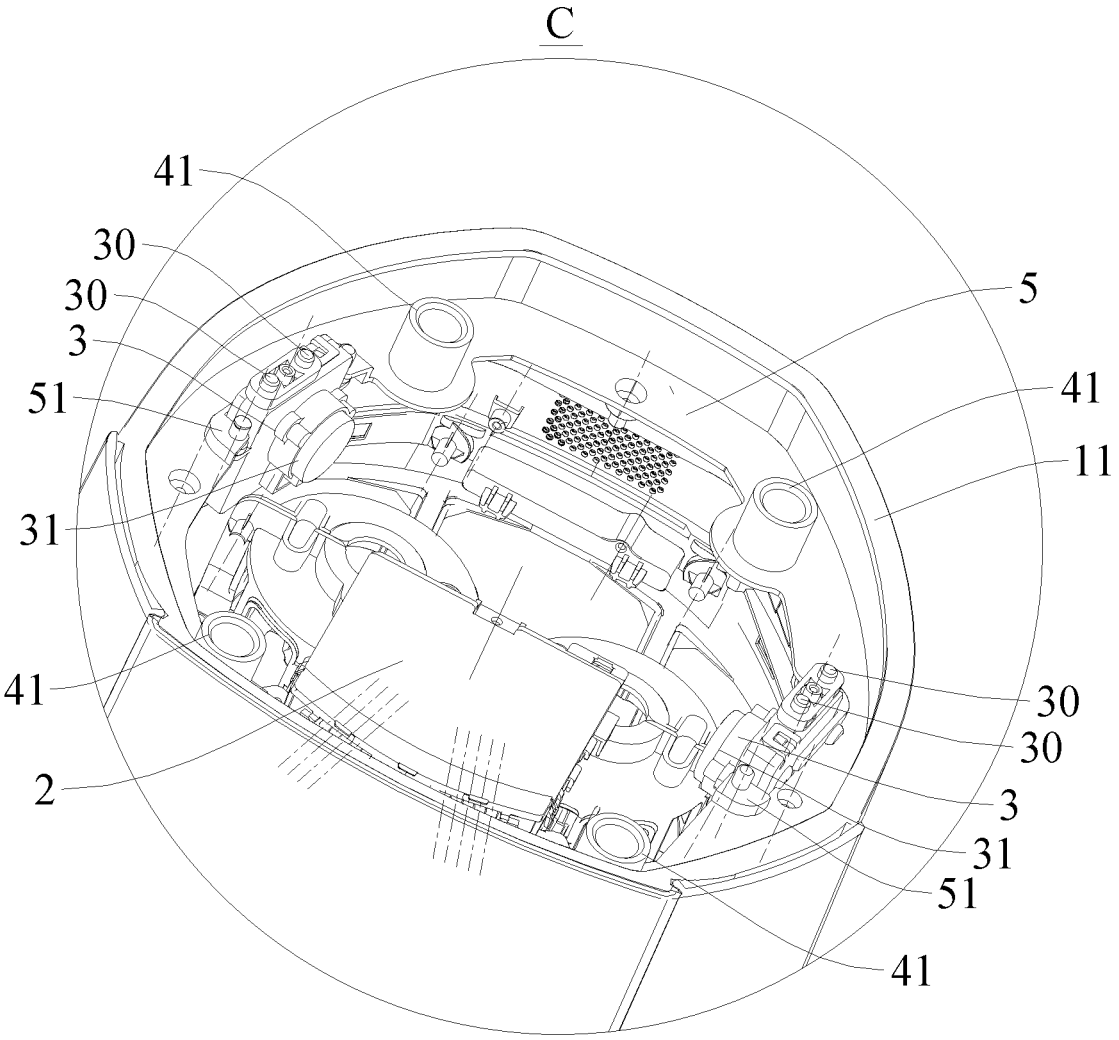
FIG. 6 is an enlarged view of a portion C as shown in a circle in FIG. 5.
Figure 10:
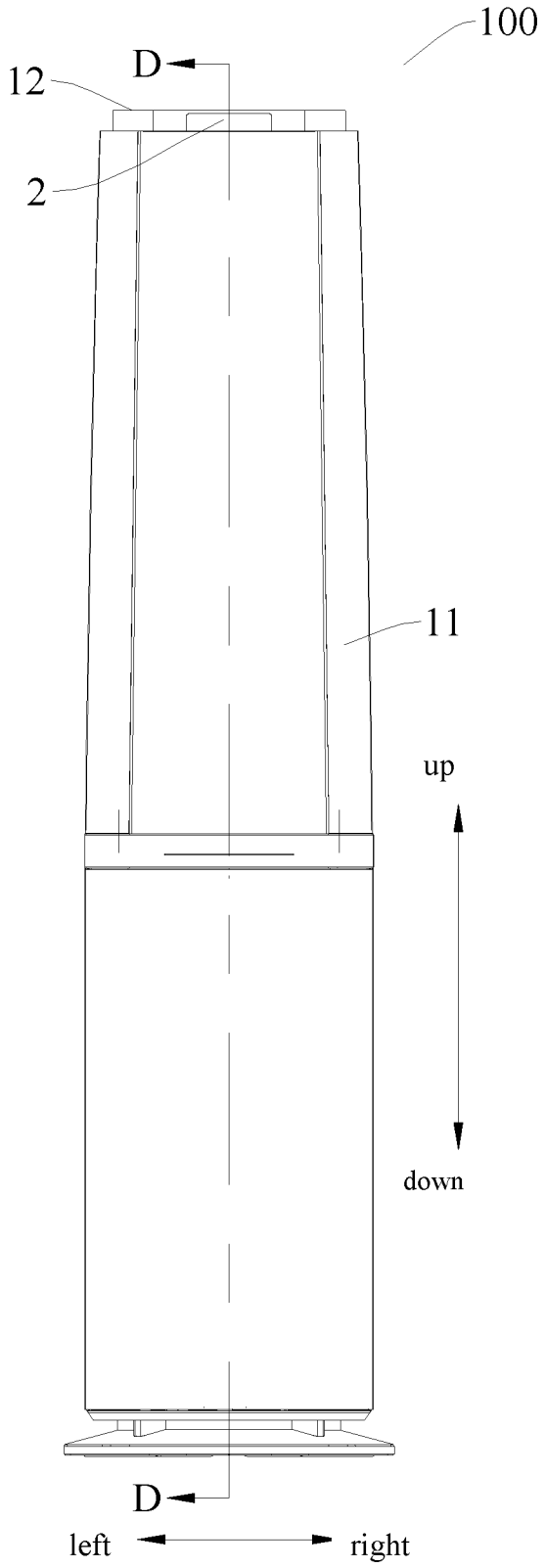
FIG. 10 is another front view of the air conditioner indoor unit shown in FIG. 1, wherein the top cover is in the detection position.
Figure 11:
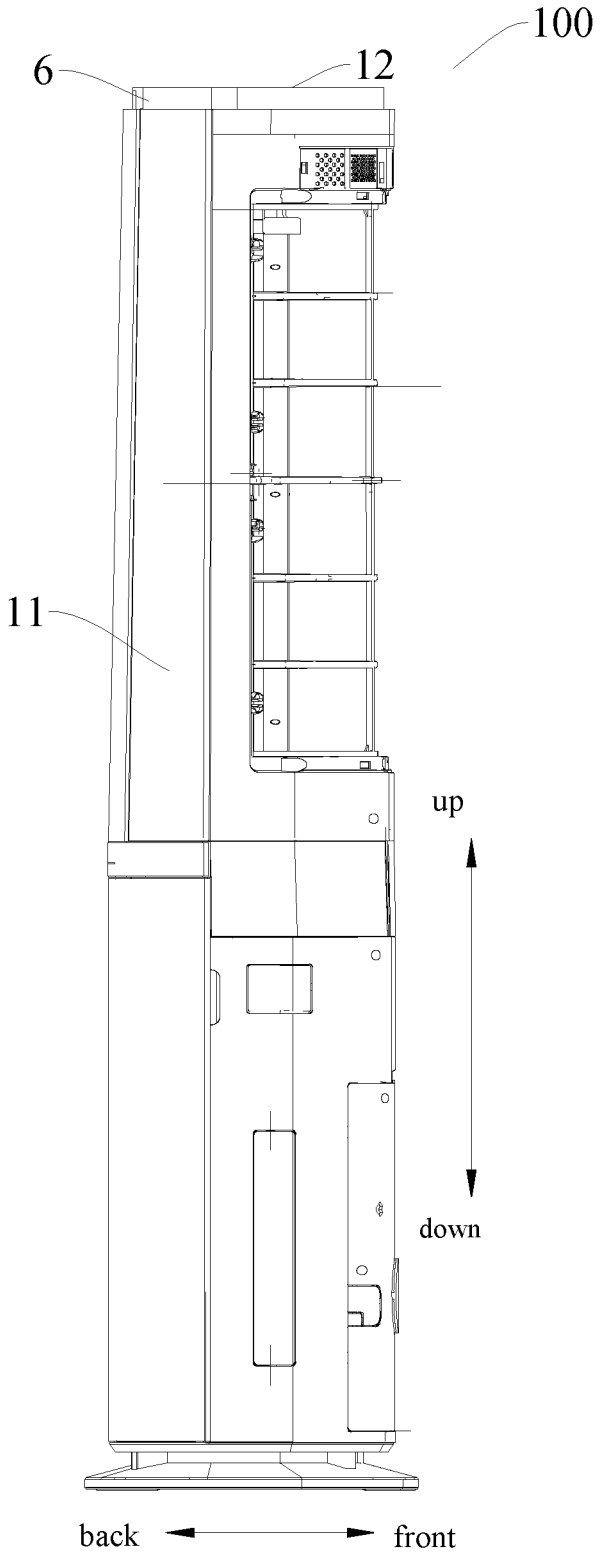
FIG. 11 is a side view of the air conditioner shown in FIG. 10.
Figure 12:
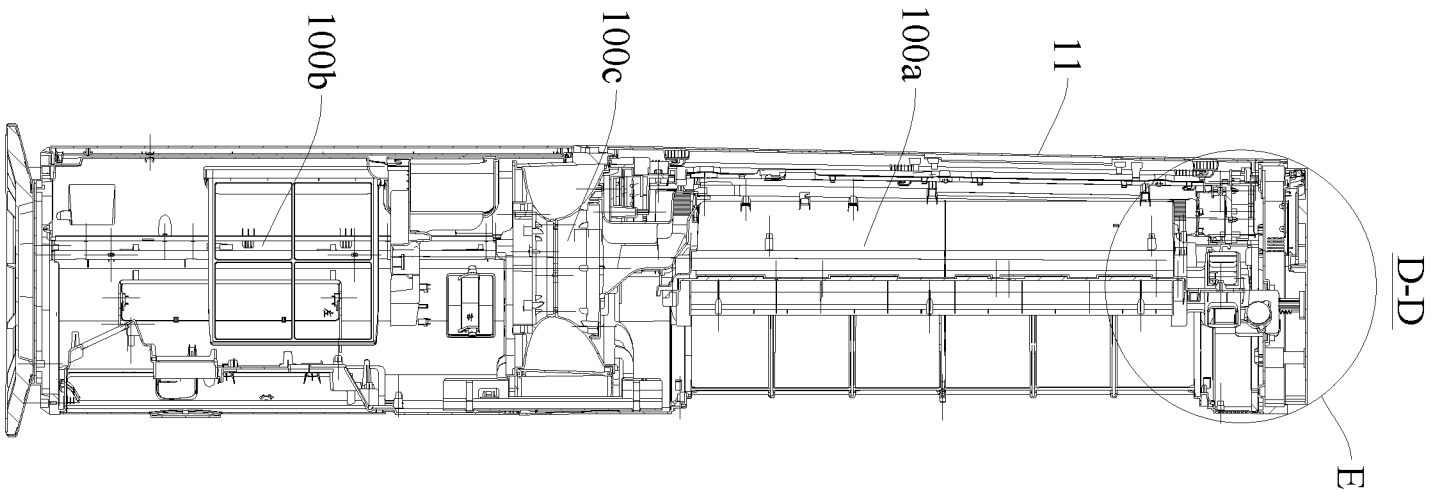
FIG. 12 is a cross-sectional view taken along line D-D of FIG. 10.

As shown in FIGS. 1, 6 and 10, the air conditioner indoor unit 100 according to the embodiment of the present disclosure includes a housing 1, a collection device 2, and a lifting device 3.

The housing 1 includes a body 11 and a top cover 12. The top of the body 11 has a fitting port 111. The top cover 12 is disposed at the fitting port 111. The collection device 2 is disposed at the top cover 12, and the lifting device 3 is positioned within the body 11. The lifting device 3 is coupled with the top cover 12 to drive the top cover 12 to be movable between a storage position and a detection position, and at the detecting position, the collection device 2 can collect the external information outside the housing 1.

When the air conditioner indoor unit 100 is operating, if the external information outside the housing 1 needs to be collected, the lifting device 3 can drive the top cover 12 to move to the detection position. At this time, the collection device 2 can detect the external information outside the housing 1 to facilitate the collection angle of view of the collection device 2. If the external information outside the housing 1 needs not to be collected, the lifting device 3 can drive the top cover 12 to move to the storage position, to realize the storage of the top cover 12 and the collection device 2. This is beneficial to ensure the privacy safety of the user and improve the user experience.

The collection device 2 can be fixedly disposed at the top cover 12, so that when the top cover 12 moves between the storage position and the detection position, the collection device 2 can move synchronously with the top cover 12. For example, the collection device 2 can be movably disposed at the top cover 12, and the collection device 2 can be moved synchronously with the top cover 12 or asynchronously with the top cover 12. However, it is not limited thereto.

It can be understood that the external information outside the housing 1 collected by the collection device 2 may include at least one of user individual position information, indoor air quality, and the like, and the information collected by the collection device 2 may be used to control the operating mode of the air conditioning indoor unit 100, or may be displayed by the display device of the air conditioner indoor unit 100 so that the user can intuitively obtain the information. However, it is not limited thereto.

The air conditioner indoor unit 100 according to the embodiments of the present disclosure is provided with the collection device 2. This facilitates to collect the external information outside the housing 1. The collected information can be used to control the operation of the air conditioner indoor unit 100, or can be intuitively displayed by the display device. The lifting device 3 is provided to realize the movement of the top cover 12 between the storage position and the detection position, thereby facilitating to collect information by the collection device 2, and ensuring that the collection device 2 has a good collection angle of view. Also, this facilitates the storage of the collection mean 2, which is beneficial to ensure the privacy safety of the user and improve the user experience. Additionally, the air conditioner indoor unit 100 has a simple structure, and is stable and reliable.

Figure 13:
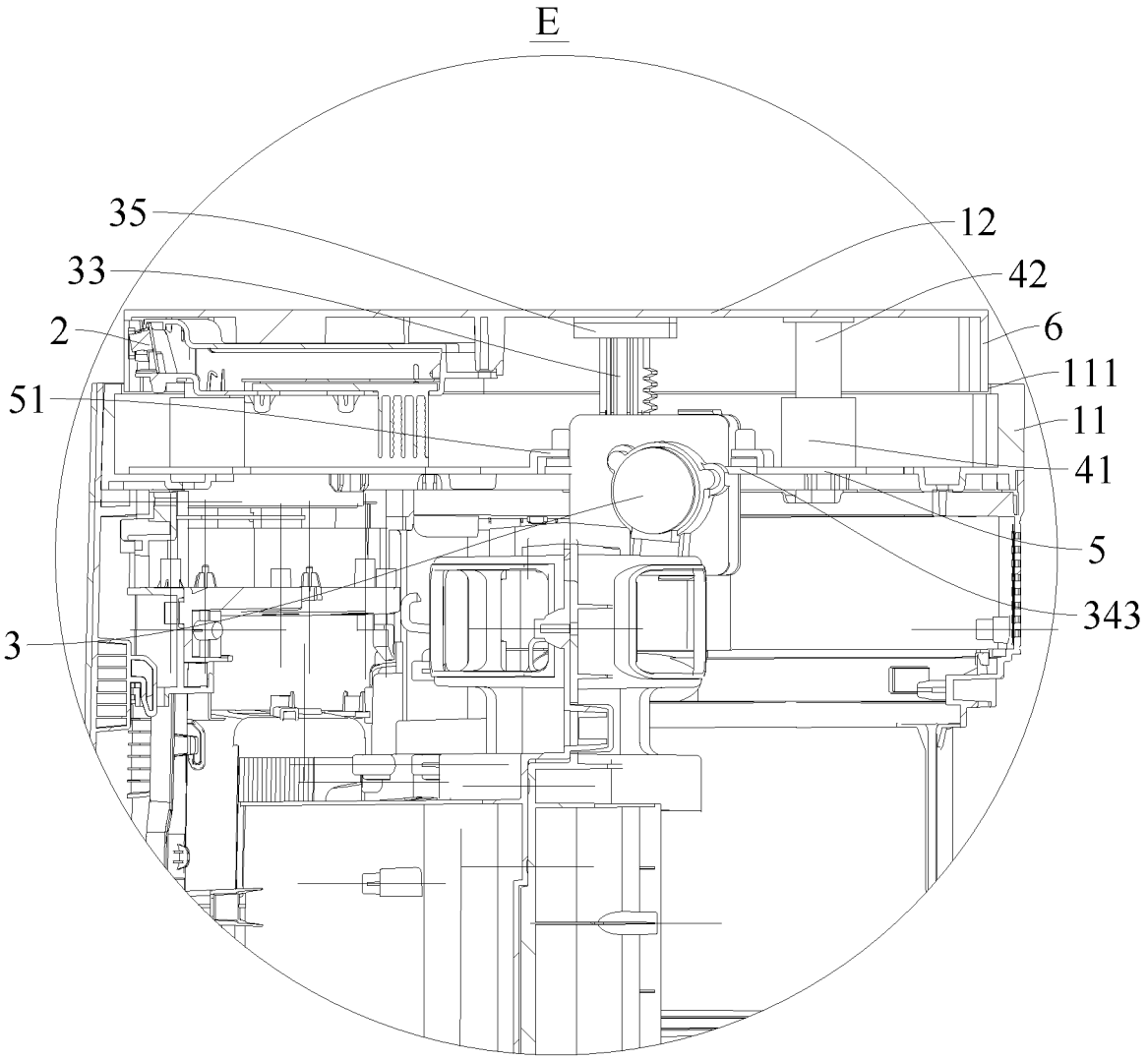
FIG. 13 is an enlarged view of a portion E as shown in a circle in FIG. 12.

In some embodiments of the present disclosure, the lifting device 3 is used to drive the top cover 12 to move above the body 11 such that the collection device 2 is located above the body 11. For example, as shown in FIGS. 10 and 13, the top side of the fitting port 111 is open, the top cover 12 is movable in the up and down direction, and the lifting device 3 can drive the top cover 2 to move above the body 11, so that the collection device 2 can be located above the body 11, thereby avoiding that the body 11 affects the collection angle of view of the collection device 2, and ensuring the collection angle of view of the collection device 2. In the meantime, no specific detection port needs to be provided on the body 11, which simplifies the manufacturing of the body 11.

It should be noted that the direction "up" may refer to the direction "up" when the air conditioner indoor unit 100 is used normally. In the description of the present disclosure, the first feature being "above" the second feature device means that the first feature is directly above or obliquely above the second feature, or merely indicates that the level of the first feature is higher than that of the second feature. For example, the lifting device 3 can drive the top cover 12 to move above the body 11. At this time, the top cover 12 can be located directly above or obliquely above the body 11.

For example, as shown in FIGS. 10 and 13, when the lifting device 3 drives the top cover 12 to move to the detection position, the top cover 12 may be located above the body 11, and the collection device 2 may be located above the body 11 so as to collect the external information outside the housing 1.

It can be understood that when the top cover 12 is moved to the detection position, the top cover 12 may not be located above the body 11; for example, the body 11 may be formed with a through detecting port when the top cover 12 is moved to the detecting position. The collection device 2 can be directly opposite to the detection port, to facilitate the collection device 2 to collect the external information outside the housing 1, and the top cover 12 can be located below the top end of the body 11. However, it is not limited thereto.

In some embodiments of the present disclosure, as shown in FIGS. 10 and 13, the collection device 2 is disposed at the inner side wall of the top cover 12 (e.g., the lower surface of the top cover 12 in FIGS. 4 and 13) such that the top cover 12 can function to block the collection device 2, thereby ensuring the concealment of the collection device 2 to a certain extent.

It can be understood that the collection device 2 can also be disposed at another position of the top cover 12, and only when the top cover 12 is in the detection position, the collection device 2 can collect the external information outside the housing 1.

Figure 4:
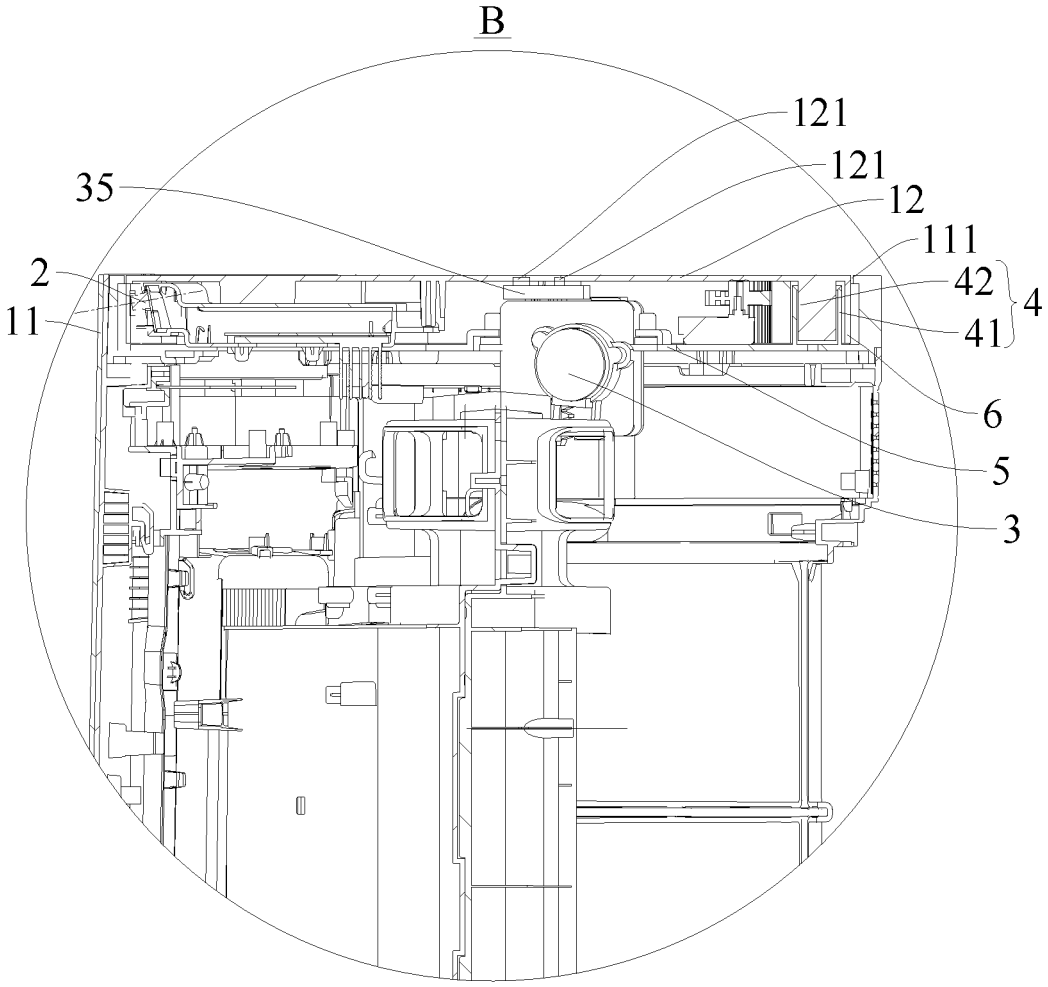
FIG. 4 is an enlarged view of a portion B as shown in a circle in FIG. 3.
Figure 5:
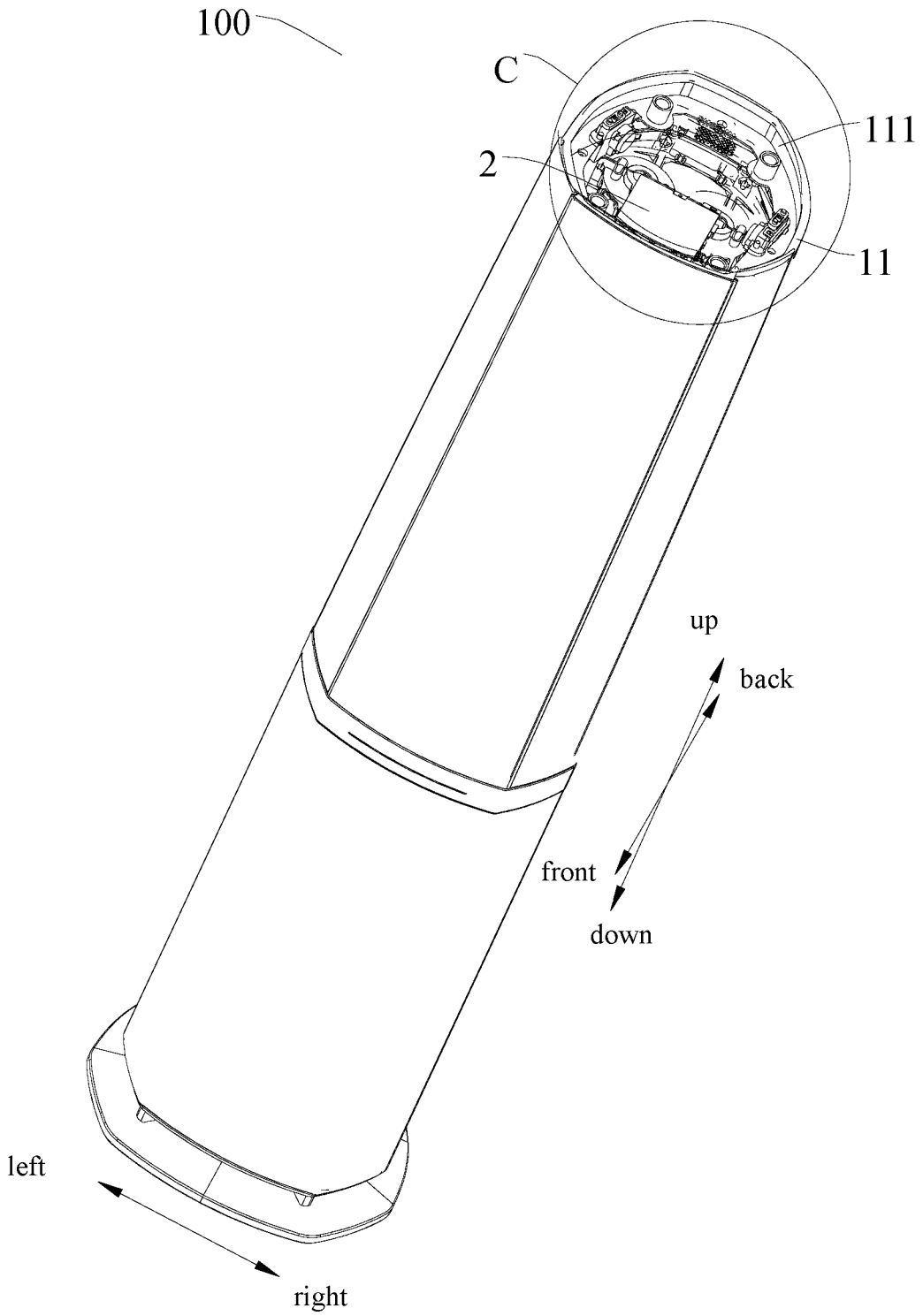
FIG. 5 is a schematic view of a partial structure of the air conditioner indoor unit shown in FIG. 1.

For example, in the examples of FIGS. 1 and 4, in the storage position, the top cover 12 is flush with the top of the body 11. Thus, the appearance of the housing 1 is regular, has good aesthetics, and both of the top cover 12 and the body 11 can block the collection device 2, so that the user cannot directly see the collection device 2 from outside the air-conditioner indoor unit 100, the confidentiality of the collection device 2 is further ensured, and privacy protection is further achieved.

In some embodiments of the present disclosure, the top of the lifting device 3 is snap-fitted with the top cover 12, thereby facilitating the disassembly and assembly between the lifting device 3 and the top cover 12 and improving the disassembly and assembly efficiency of the air conditioning indoor unit 100. Also, it is not necessary to form an opening hole or the like on the appearance surface of the top cover 12, so as to ensure that the top cover 12 has a flat appearance surface.

It can be understood that there may be other connections between the top of the lifting device 3 and the top cover 12. For example, the top of the lifting device 3 and the top cover 12 may also be connected by a threaded connection member.

Figure 7:
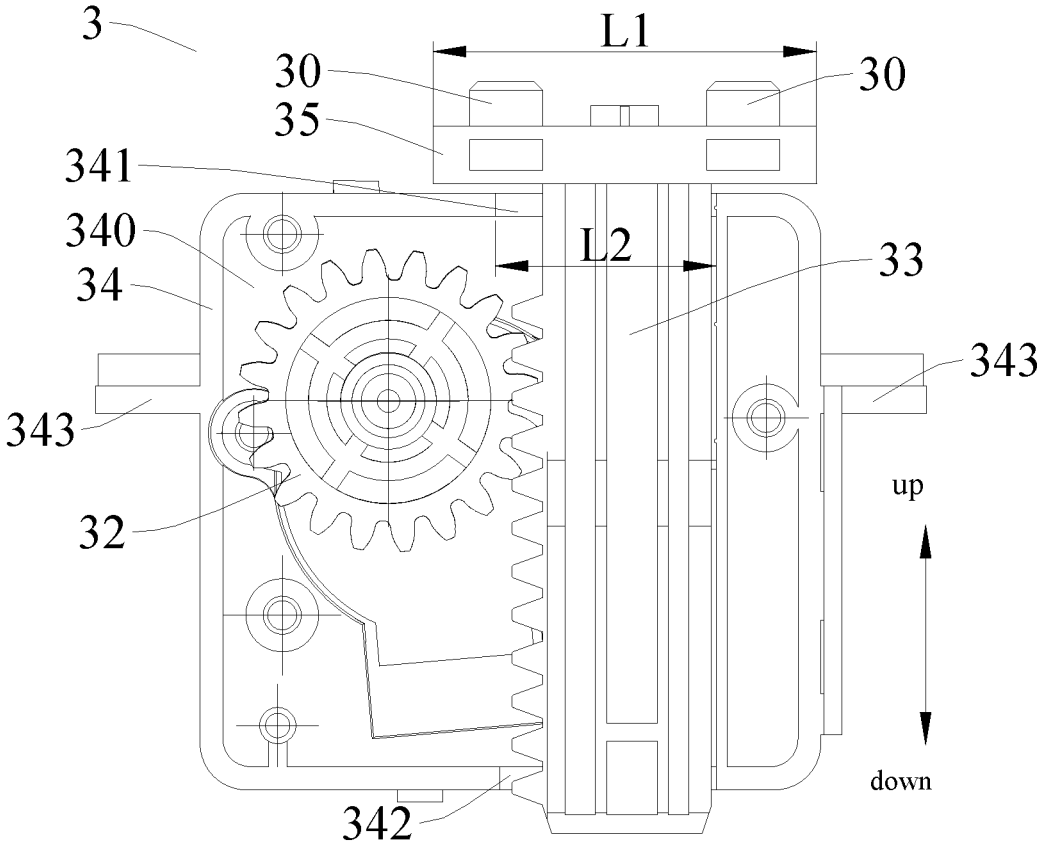
FIG. 7 is a schematic structural view of the lifting device shown in FIG. 6.

For example, in the examples of FIG. 4 and FIG. 7, the top cover 12 is provided with a positioning hole 121, and the positioning hole 121 may be formed by recessing upwardly a part of the lower surface of the top cover 12. The top of the lifting device 3 is provided with a positioning post 30, the positioning post 30 can be formed by a part of the upper surface of the lifting device 3 that extends upwards, and the positioning post 30 protrudes into the positioning hole 121, thereby achieving a snap fit between the lifting device 3 and the top cover 12. The structure is simple and is convenient to implement.

For example, in the examples of FIG. 4, FIG. 6 and FIG. 7, the top of the lifting device 3 may be provided with two positioning posts 30 arranged separately. The top cover 12 is correspondingly provided with two positioning holes 121, and the two positioning holes 121 can be in one-to-one correspondence with the two positioning posts 30. When the top cover 12 is installed, at least a portion of each of the positioning posts 30 protrudes into the positioning hole 121 to achieve the fitting between the positioning post 30 and the positioning hole 121, so as to achieve the position limitation of the top cover 12 and prevent the position of the top cover 12 from rotating about the axial direction of the positioning post 30 in relation to the lifting device 30, so that the top cover 12 can be quickly installed on the fitting port 111, and the assembly efficiency of the air conditioner indoor unit 100 is further improved. When the top cover 12 is disassembled, the top cover 12 can be moved upwardly to disengage the positioning post 30 from the positioning hole 121, thereby realizing the disassembly of the top cover 12 and further improving the disassembly efficiency of the air conditioner indoor unit 100.

The top of the lifting device 3 is provided with one, or three, or more than three positioning posts 30. The number of the positioning holes 121 may be equal to or different from that of the positioning posts 30. The cross-sectional shape of the positioning post 30 can be a circle, or a polygon, or an ellipse or the like.

In some embodiments of the present disclosure, the lifting device 3 includes a motor 31, a gear 32 and a rack 33. The motor 31 is positioned within the body 11, the gear 32 cooperates with the motor 31 to be driven to rotate by the motor 31, the rack 33 and the gear 32 are engaged, and the top end of the rack 33 is coupled with the top cover 12 to drive the top cover 12 to move. For example, as shown in FIGS. 4 and 7, the motor 31 can be fixedly mounted in the body 11, and the rack 33 can be linearly extended in the up and down direction. When the motor 31 is operating, the gear 32 can be driven to be rotated so as to drive the rack 33 in the length direction of the rack 33, so that the rack 33 can move the top cover 12 up and down, and the movement of the top cover 12 between the storage position and the detection position is achieved. Thus, the motor 31, the gear 32 and the rack 33 are provided to convert the rotation of the motor 31 into the movement of the rack 33, thereby realizing the movement of the top cover 12. The structure is simple, the operation is stable, and the usage is reliable. The gear 32 can be directly driven to rotate by the motor 31 or indirectly by the motor 31.

It can be understood that the lifting device 3 can also be the other device that can realize the movement of the top cover 12, without being limited thereto.

For example, as shown in FIGS. 6 and 7, the number of the lifting device 3 is two and the two lifting devices 3 are distributed on the left and right sides of the top cover 12. The two lifting devices 3 can be disposed adjacent to the outer periphery of the top cover 12, and the two lifting devices 3 can simultaneously drive the top cover 12 to move, to ensure that the top cover 12 is stressed relatively evenly, thereby reducing the supporting force and supporting area of each lifting device 3 to the top cover 12 under the premise of ensuring the smooth movement of the top cover 12. Moreover, the strength requirement of the lifting device 3 is reduced, and the space occupied by the lifting device 3 is also saved, which is advantageous for improving the utilization rate of the internal space of the air conditioner indoor unit 100.

It should be noted that the directions "left" and "right" may refer to the left side and the right side of the user when the air conditioner indoor unit 100 is normally used and the user is located in front of the air conditioner indoor unit 100 and faces the air conditioner indoor unit 100.

It can be understood that the number of the lifting device 3 can also be three or more. For example, when the number of the lifting device 3 is three, the three lifting devices 3 can be disposed separately along the circumferential direction of the top cover 12.

Figure 8:
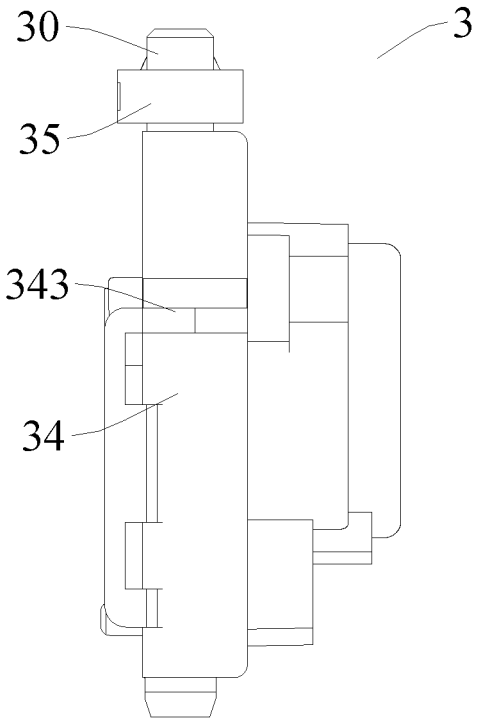
FIG. 8 is another schematic structural view of the lifting device shown in FIG. 7.
Figure 9:
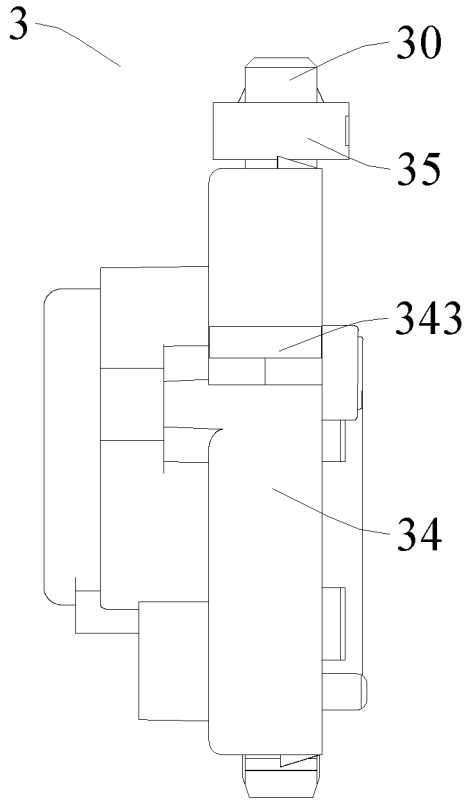
FIG. 9 is another schematic structural view of the lifting device shown in FIG. 7.

For example, the lifting device 3 further includes a casing 34 in which the motor 31 and the gear 32 are stored, and the top of the casing 34 is provided with an opening 341 through which the rack 33 can protrude from the casing 34. For example, as shown in FIGS. 7-9, the installation space 340 can be defined in the casing 34, and the motor 31 and the gear 32 are installed in the installation space 340 to prevent foreign matter such as water and dust from affecting the service life of the motor 31 and the gear 32. This functions to protect the motor 31 and the gear 32. Moreover, the lifting device 3 can be formed integrally to facilitate the modular design of the lifting device 3. The opening 341 can penetrate the top wall of the casing 34 to allow the installation space 340 to communicate with the external environment through the opening 341. This facilitates the coupling of the top end of the rack 33 with the top cover 12, while ensuring the smooth movement of the rack 33 and avoiding the interference between the casing 34 and the rack 33.

In the example of FIG. 7, the bottom of the casing 34 may further be formed with a through hole 342. The through hole 342 may penetrate the bottom wall of the casing 34 so that the installation space 340 may also communicate with the external environment through the through hole 342. The through hole 342 can be opposite to the opening 341 in the up-down direction, and the lower end of the rack 33 can be extended out of the casing 34 through the through hole 342. The length of the rack 33 can be designed to be long without being restricted by the casing 34, and it ensures that the rack 33 has sufficient movement distance, thereby ensuring that the top cover 12 moves between the storage position and the detection position, so that the collecting device 2 collects the external information outside the housing 1.

In some embodiments of the present disclosure, the air conditioner indoor unit 100 further includes a first sliding portion 41 and a second sliding portion 42 that are slidably fitted, the first sliding portion 41 is positioned within the housing 1, and the second sliding portion 42 is coupled to the top cover 12. For example, as shown in FIG. 4, FIG. 6, and FIG. 13, the first sliding portion 41 may be fixedly disposed in the body 11, the top end of the second sliding portion 42 may be coupled to the top cover 12, the first sliding portion 41 and the second sliding portions 42 may each extend in the up-down direction, the first sliding portion 41 is slidably fitted with the second sliding portion 42, and the first sliding portion 41 and the second sliding portion 42 move in relation to each other in the up-down direction, to change a length of the overlapping portion of the first sliding portion 41 and the second sliding portion 42 in the up-down direction, thereby changing the length of the sliding portion 4 constituted by the first sliding portion 41 and the second sliding portion 42. For example, the first sliding portion 41 and the second sliding portion 42 may move toward each other in the up-down direction to reduce the length of the sliding portion 4, or the first sliding portion 41 and the second sliding portion 42 may move away from each other in the up-down direction to increase the length of the sliding portion 4. Therefore, during the movement of the top cover 12 between the storage position and the detection position, the second sliding portion 42 slides up and down with respect to the first sliding portion 41, which can further limit the position of the top cover 12, restrict the movement direction of the top cover 12, and ensure the stability of the movement of the top cover 12.

In some embodiments of the present disclosure, the second sliding portion 42 protrudes into the first sliding portion 41, further ensuring the stability of the sliding fit of the first sliding portion 41 and the second sliding portion 42, and further ensuring the stability of the movement of the top cover 12. For example, in the examples of FIGS. 4, 6, and 13, the second sliding portion 42 may be formed to have a columnar structure, the first sliding portion 41 may be formed to have a cylindrical structure, and the lower end of the second sliding portion 42 may extend downwardly into the first sliding portion 41. Thus, the first sliding portion 41 and the second sliding portion 42 are simple in structure and it is easy to implement their structures.

In the example of FIG. 6, the number of the first sliding portion 41 and the number of the second sliding portion 42 are respectively four, the four second sliding portions 42 may be disposed adjacent to the outer periphery of the top cover 12, and the four second sliding portions 42 may be in the square arrangement. That is, two of the four second sliding portions 42 may be located at the front side of the top cover 12, the other two may be located at the rear side of the top cover 12, and the two of the four second sliding portions 42 can be disposed separately on right and left sides, and the other two can also be disposed separately on right and left sides. Thereby, the stability of the movement of the top cover 12 is improved.

Of course, one, or two, or three, or more than four first sliding portion 41 and one, or two, or three, or more than four second sliding portion 42 may also be provided respectively. The number of the first sliding portions 41 may be equal or unequal to the number of the second sliding portions 42.

In some embodiments of the present disclosure, the air conditioner indoor unit 100 further includes a fixing plate 5 disposed at the inner peripheral wall of the body 11, and the first sliding portion 41 is disposed at the fixing plate 5, thereby facilitating the arrangement of the first sliding portion 41 and facilitating the simplification of the structure of the first sliding portion 41. For example, as shown in FIG. 4, FIG. 6, and FIG. 13, the fixing plate 5 may be located below the top end of the body 11, and the fixing plate 5 may be disposed adjacent to the top end of the body 11. To some extent, the lengths of the first sliding portion 41 and the second sliding portion 42 in the up-down direction may be appropriately reduced, thereby reducing the cost. A portion of the inner peripheral wall of the body 11 may extend inwardly to form the fixing plate 5, so that the fixing plate 5 may be formed to have a ring shape or an open ring shape. The fixing plate 5 may be horizontally disposed, the first sliding portion 41 may be disposed at the upper surface of the fixing plate 5, and a portion of the upper surface of the fixing plate 5 may extend upwardly to form the first sliding portion 41. Thus, the first sliding portion 41 has a simple structure and it is convenient to process.

It should be noted that the direction "inward" may refer to a direction close to the central axis of the air conditioner indoor unit 100, and the "opening ring" refers to an annular shape having an opening (i.e., a non-closed ring shape), wherein "ring" should be understood in a broad sense, that is, it is not limited to "circular ring", for example, it can also be "polygon ring" and so on.

For example, in the examples of FIGS. 6 and 13, the lifting device 3 is fixed at the fixing plate 5, and the fixing plate 5 may be formed with a mounting position 51. The lifting device 3 may be correspondingly mounted at the mounting position 51, so as to realize installation of the lifting device 3. When the fixing plate 5 is disposed adjacent to the top end of the body 11, the distance between the lifting device 3 and the top cover 12 is made to be small, so that the lifting device 3 stably drives the top cover to move.

As shown in FIG. 6 and FIG. 13, the mounting position 51 can be formed substantially as a groove, and the lower surface of the fixing plate 5 can be recessed upwardly to form the mounting position 51. The top wall of the mounting position 51 is formed with a through mounting opening which penetrates to the inner periphery of the fixing plate 5, and the lifting device 3 is fitted to the mounting opening and has a mounting portion 343 at each end of the lifting device 3 in the circumferential direction of the fixing plate 5. The mounting portion 343 can be formed substantially as a lug. The mounting portions 343 are all fitted to the mounting position 51 and are fixedly coupled to the mounting position 51, thereby realizing the mounting of the lifting device 3.

In some embodiments of the present disclosure, as shown in FIGS. 4 and 13, the air conditioner indoor unit 100 further includes a guiding plate 6 for guiding the top cover 12 to move, and the guiding plate 6 extends downwardly from the outer periphery of the top cover 12. The guiding plate 6 can be formed to have a ring shape or an open ring shape. The guiding plate 6 is located inside the fitting port 111. During the movement of the top cover 12, the guiding plate 6 can function to guide the direction, facilitating the rapid movement of the top cover 12 to achieve the position switching. Moreover, it is convenient to enhance the strength of the top cover 12 and ensure the reliability of use of the top cover 12.

The guiding plate 6 and the top cover 12 can be integrally formed, so as to ensure the positioning accuracy between the guiding plate 6 and the top cover 12, improve the shaping efficiency of the guiding plate 6 and the top cover 12, reduce the assembly processes, and improve the assembling efficiency of the air conditioner indoor unit 100. Further, it is unnecessary to form the connecting holes on the guiding plate 6 and the top cover 12, the structures of the guiding plate 6 and the top cover 12 is simplified, and the processing is facilitated.

It can be understood that the guiding plate 6 can be formed to have a ring shape. At this time, the guiding plate 6 can be formed with an escaping port facing the collection device 2 to facilitate the collection device 2 to collect information; but is not limited thereto. When the top cover 12 is moved to the detection position, if the top cover 12 is located above the body 11, the top end of the guiding plate 6 is located above the body 11, and the bottom end of the guiding plate 6 may be located above the top end of the body 11, or be flush with the top end of the body 11, or be located below the top end of the body 11. If the top cover 12 is moved to the detection position and the bottom end of the guiding plate 6 is not located above the top end of the body 11, the guiding plate 6 can effectively shield the internal structure of the body 11, thereby ensuring the aesthetic appearance of the housing 1 and facilitating to ensure the cleanness of the interior of the body 11.

For example, the collection device 2 is a camera, and the camera can be used for video capturing, propagation, still image capturing and the like, so that the camera can record the outside of the housing 1 and can function to monitor, which is convenient for the user to perform security work. It can be understood that the camera can also be used to acquire location information of individual user located indoors.

Of course, the collection device 2 can also be other device, such as an infrared device or the like.

When the air conditioner indoor unit 100 is applied to an air conditioner, the type of the air conditioner can be wall-hanging air conditioner, or a floor type air conditioner or the like.

Other configurations and operations of the air conditioner indoor unit 100 according to embodiments of the present disclosure are known to those skilled in the art and will not be described in detail herein.

The air conditioner indoor unit 100 according to an embodiment of the present disclosure will be described in detail below with reference to the accompanying drawings in a specific embodiment. It is to be understood that the following description is only illustrative, and not restrictive.

As shown in FIGS. 1, 6, and 10, the air conditioner indoor unit 100 includes a housing 1, a collection device 2, and a lifting device 3. An indoor heat exchanger 100*a* and an air processor 100*b* may be disposed in the housing 1. The indoor heat exchanger 100*a* and the air treatment device 100*b* may be disposed separately in the up-down direction, and an intermediate support 100*c* may be disposed between the indoor heat exchanger 100*a* and the air treatment device 100*b*. The air conditioner indoor unit 100 can adjust the temperature, humidity, and the like of the indoor air, and can also purify the indoor air.

The indoor heat exchanger 100*a* includes an indoor fan and an indoor heat exchanger. The housing 1 is formed with an air inlet and an air outlet. A heat exchange duct that communicates with the air inlet and the air outlet is defined within the housing 1, and the indoor fan and the indoor heat exchanger are all disposed in the housing 1. The air treatment device 100*b* includes a guiding fan and a purifying device. The housing 1 is formed with an air inlet and an air outlet. An air treatment duct communicating with the air inlet and the air outlet is further defined in the housing 1. The air treatment duct can be isolated from the heat exchange duct in the indoor heat exchanger 100*a*, so that the air flowing into the air treatment duct from the air inlet does not flow into the heat exchange duct, thereby preventing the air treatment device 100*b* from affecting the heat exchange efficiency of the indoor heat exchanger 100*a*, and ensuring the cooling/heating efficiency of the air conditioner indoor unit 100.

When the indoor heat exchanger 100*a* is operating, the indoor fan operates to generate a negative pressure at the air inlet, the air flows into the heat exchange duct from the air inlet and exchanges the heat with the indoor heat exchanger under the driving action of the indoor fan, and the air after the heat exchange flows out of the air outlet to regulate the room temperature. The air treatment device 100*b* operates to guide the fan to operate so as to generate a negative pressure at the air inlet. The air (referring to indoor air and/or outdoor air) can flow from the air inlet into the air treatment duct and pass through the purifying device. When the air passes through the purifying device, the dust particles in the air adhere onto the purifying device, thereby purifying the air. The purified air flows to the indoor from the air outlet, thereby ensuring the health of the user and improving the indoor comfort.

As shown in FIG. 4, FIG. 6, and FIG. 13, the housing 1 includes a body 11 and a top cover 12. The top of the body 11 has a fitting port 111. The top side of the fitting port 111 is open, and the top cover 12 is disposed at the fitting port 111. The collection device 2 is fixedly disposed at the lower surface of the top cover 12, the lifting device 3 is positioned in the body 11, the top of the lifting device 3 is snap-fitted with the top cover 12, and the lifting device 3 is used to drive the top cover 12 to move between the storage position (as shown in FIG. 4) and the detection position (as shown in FIG. 13). The detection position is located directly above the storage position. When the top cover 12 is moved to the detection position, the top cover 12 is located above the body 11. At this time, the collection device 2 is located above the body 11 to collect the external information outside the housing 1. When the top cover 12 is moved to the storage position, the top cover 12 is flush with the top of the body 11, the collection device 2 is located inside the body 11, and the collection device 2 is blocked by the body 11. The collection device 2 is a camera.

There are two lifting devices 3 which are arranged at the left and right sides of the top cover 12, and each lifting device 3 is disposed adjacent to the outer periphery of the top cover 12. Each lifting device 3 includes a motor 31, a gear 32, a rack 33 and a casing 34. The casing 34 is positioned within the body 11, the motor 31 and the gear 32 are stored in the casing 34, the gear 32 cooperates with the motor 31 to be driven to rotate by the motor 31, and the rack 33 engages with the gear 32. The rack 33 extends linearly in the vertical direction. The top of the casing 34 is provided with an opening 341, the bottom of the casing 34 is formed with a through hole 342, the top end of the rack 33 protrudes from the casing 34 through the opening 341, and the bottom end of the rack 33 can protrude from the casing 34 through the through hole 342. The top end of the rack 33 is provided with a supporting member 35, so that the top end of the rack 33 is coupled to the top cover 12 through the supporting member 35 to drive the top cover 12 to move. Also, the action area of the acting force of the rack 33 on the top cover 12 can be increased, which ensures that the supporting member 35 has a good supporting effect. The area of the projection of the supporting member 35 on the upper surface of the casing 34 is larger than that of the opening 341 on the upper surface of the casing 34, and the length L1 of the supporting member 35 is greater than the length L2 of the opening 341 in the corresponding direction, so that the supporting member 35 may function to the position limiting.

As shown in FIG. 4 and FIG. 7, the top cover 12 is provided with a positioning hole 121. The top of the supporting member 35 is provided with two positioning posts 30 spaced apart from each other. Each positioning post 30 extends upwardly to extend into the positioning hole 121. Thus, a snap fit between the supporting member 35 and the top cover 12 is achieved.

As shown in FIG. 4, FIG. 6, and FIG. 13, the air conditioner indoor unit 100 further includes a sliding portion 4, a fixing plate 5, and a guiding plate 6. There are four sliding portions 4, and the four sliding portions 4 are arranged in a square shape. The fixing plate 5 is horizontally disposed under the top end of the body 11, and the fixing plate 5 is disposed at the inner peripheral wall of the body 11. The guiding plate 6 extends downwardly from the outer periphery of the top cover 12, and the guiding plate 6 is located inside the fitting port 111 and is used for guiding the movement of the top cover 12, and when the top cover 12 is moved to the detection position, the bottom end of the guiding plate 6 is located below the top end of the body 11. The casing 34 is fixed at the fixing plate 5 to realize the installation of the lifting means 3. Each sliding portion 4 includes a first sliding portion 41 and a second sliding portion 42 that are slidably fitted. The first sliding portion 41 is disposed at the upper surface of the fixing plate 5, the first sliding portion 41 is located within the housing 1, and the first sliding portion 41 is formed to have a cylindrical structure. The second sliding portion 42 is provided at the lower end of the top cover 12, the second sliding portion 42 is coupled to the top cover 12, the second sliding portion 42 may be formed to have a columnar structure, and the second sliding portion 42 protrudes into the first sliding portion 41.

When the air conditioner indoor unit 100 is operating, if the collection device 2 is turned on, the lifting device 3 operates to drive the top cover 12 to move to the detection position. At this time, the top cover 12 is located above the body 11, and the collection device 2 is also located above the body 11. The collection device 2 can collect the external information outside the housing 1, such as video recording. If the collection device 2 is turned off, the lifting device 3 operates to drive the top cover 12 to move to the storage position. At this time, the top cover 12 is flush with the top of the body 11, and the collection device 2 is located in the body 11 and is blocked by the top cover 12, to achieve a hidden setting of the collection device 2.

The air conditioner indoor unit 100 according to the present disclosure is provided with the collection device 2, to facilitate the collection of the external information outside the housing 1. The collected information can be used to control the operation of the air conditioner indoor unit 100, or can be intuitively displayed to the user by the display device. The lifting device 3 is provided to realize the movement of the top cover 12 between the storage position and the detection position, and thus realize the movement of the collection device 2, so that the collection device 2 collects the information. This ensures that the collection device 2 has a good collection angle of view and a simple structure, stable and reliable.

In the description of the present disclosure, it should be understood that the orientations or positional relationships indicated by the terms "upper", "lower", "front", "rear", "left", "right" and the like are orientations or positional relationships shown in the drawings, merely for facilitating to the description of the present disclosure and the simplification of the description. It is not intended to indicate or imply that the referred devices or units must have specific orientations, are constructed and operated in specific orientations, and therefore cannot be construed as limitation to the present disclosure.

In the description of the present disclosure, it should be noted that the terms "installation", "coupled", and "connected" are to be understood broadly, unless otherwise specifically defined. For example, it may be a fixed or detachable connection, or the integral connection, or integrally connected; can be mechanical or electrical connection; can be direct connection, or indirectly connection through an intermediate medium, can be the internal communication of the two components, The specific meanings of the above terms in the present disclosure can be understood for those skilled in the art in the specific situations.

In the description of the present specification, the description by the terms "one embodiment," "some embodiments," "specific embodiments" and the like device that a particular feature, structure, material or characteristic described in combination with the embodiment or example is included in at least one embodiment or example of the present disclosure. In the present specification, the schematic representation of the above terms does not necessarily refer to the same embodiment or example. Furthermore, the particular features, structures, materials or characteristics described may be combined in any suitable manner in any one or more embodiments or examples.

While the embodiments of the present disclosure have been shown and described, it will be understood by those skilled in the art that various variations, modifications, substitutions and modifications of these embodiments can be made without departing from the spirit and scope of the disclosure, and the scope of the invention is defined by the claims and their equivalents.

What is claimed is:

1. An air conditioner indoor unit, comprising:

a housing including:

a body, a top of the body including a fitting port;

a top cover disposed at the fitting port;

a fixing plate disposed at an inner peripheral wall of the body, the fixing plate being a horizontally disposed plate, and the fixing plate being disposed adjacent to the top of the body;

a first sliding portion positioned inside the body, the first sliding portion being arranged at an upper surface of the fixing plate; and a second sliding portion slidably fitted with the first sliding portion and coupled to the top cover;

a collection device disposed at the top cover; and a lifting device coupled to the top cover and configured to drive the top cover to move between a storage position and a detection position that allows the collection device to collect external information outside the housing.

2. The air conditioner indoor unit of claim 1, wherein the lifting device is configured to drive the top cover to move above the body to the detection position such that at least a portion of the collection device is positioned above the body.

3. The air conditioner indoor unit of claim 1, wherein the collection device is disposed at an inner side wall of the top cover.

4. The air conditioner indoor unit of claim 3, wherein, at the storage position, the top cover is flush with the top of the body.

5. The air conditioner indoor unit of claim 1, wherein a top of the lifting device is snap-fitted with the top cover.

6. The air conditioner indoor unit of claim 5, wherein the top cover includes a positioning hole, and the top of the lifting device includes a positioning post protruding into the positioning hole.

7. The air conditioner indoor unit of claim 1, wherein the lifting device includes:

a motor positioned within the body;

a gear cooperating with the motor and configured to be driven by the motor to rotate; and a rack engaging with the gear, a top end of the rack being coupled to the top cover.

8. The air conditioner indoor unit of claim 7, wherein the lifting device is a first lifting device coupled to a first position of the top cover;

the air conditioner indoor unit further comprising:

a second lifting device arranged at a second position of the top cover.

9. The air conditioner indoor unit of claim 7, wherein the lifting device is one of a plurality of lifting devices of the air conditioner indoor unit that are coupled to and distributed evenly at the top cover.

10. The air conditioner indoor unit of claim 7, wherein:

the lifting device further includes a casing, a top of the casing including an opening;

the motor and the gear are accommodated in the casing; and the rack is configured to at least partially protrude out of the casing through the opening.

11. The air conditioner indoor unit of claim 1, wherein the second sliding portion protrudes into the first sliding portion.

12. The air conditioner indoor unit of claim 1, wherein a portion of the lifting device is fixed at the fixing plate.

13. The air conditioner indoor unit of claim 1, further comprising:

a guiding plate configured to guide the top cover to move, the guiding plate extending downward from an outer periphery of the top cover and being located inside the fitting port.

14. The air conditioner indoor unit of claim 1, wherein the collection device includes a camera.

15. The air conditioner indoor unit of claim 1, wherein the first sliding portion is arranged at the fixing plate and extends upward from the fixing plate.

16. The air conditioner indoor unit of claim 1, wherein at both the storage position and the detection position, the collection device is located above the fixing plate.

17. The air conditioner indoor unit of claim 1, wherein a portion of the upper surface of the fixing plate extends upwardly to form the first sliding portion.

18. The air conditioner indoor unit of claim 1, wherein both the first sliding portion and the second sliding portion are perpendicular to the fixing plate, and a moving direction of the top cover driven by the lifting device is perpendicular to the fixing plate.

19. The air conditioner indoor unit of claim 1, further comprising:

a guiding plate configured to guide the top cover to move, the guiding plate extending downward from an outer periphery of the top cover and being located inside the fitting port, the guiding plate having a ring shape with an escaping port facing the collection device.

20. An air conditioner indoor unit, comprising:

a housing including:

a body, a top of the body including a fitting port;

a top cover disposed at the fitting port;

a fixing plate disposed at an inner peripheral wall of the body, and the fixing plate being disposed adjacent to the top of the body;

a first sliding portion positioned inside the body, a portion of an upper surface of the fixing plate extending upwardly to form the first sliding portion; and a second sliding portion slidably fitted with the first sliding portion and coupled to the top cover;

a collection device disposed at the top cover; and a lifting device coupled to the top cover and configured to drive the top cover to move between a storage position and a detection position that allows the collection device to collect external information outside the housing.

* * * * *